US005461981A

United States Patent [19]

Schneider

[11] Patent Number: 5,461,981

[45] Date of Patent: Oct. 31, 1995

[54] PRESS BLANKET CYLINDER WITH BLANKET END EJECTION DEVICE

[75] Inventor: Georg Schneider, Würzburg, Germany

[73] Assignee: Koenig & Bauer Aktiengesellschaft, Wurzburg, Germany

[21] Appl. No.: 285,298

[22] Filed: Aug. 3, 1994

[30] Foreign Application Priority Data

Aug. 5, 1993 [DE] Germany ..... 43 26 251.1

[51] Int. Cl.[6] ..... B41F 27/00

[52] U.S. Cl. ..... 101/415.1; 101/382.1; 101/409; 101/411

[58] Field of Search ..... 101/415.1, 409, 101/411, 382.1, 383–386, 389

[56] References Cited

U.S. PATENT DOCUMENTS

| | | | |
|---|---|---|---|
| 2,929,323 | 3/1960 | Burgard . | |
| 3,625,151 | 12/1971 | Hart | 101/415.1 |
| 3,844,214 | 10/1974 | Smith . | |
| 4,183,299 | 1/1980 | Cappel | 101/415.1 |
| 4,646,639 | 3/1987 | Gollinger et al. | 101/415.1 |
| 4,802,413 | 2/1989 | Schroeder | 101/415.1 |
| 4,833,986 | 5/1989 | Kobler . | |
| 5,315,931 | 5/1994 | Doersam | 101/415.1 |
| 5,359,933 | 11/1994 | Blaser et al. | 101/415.1 |
| 5,365,848 | 11/1994 | Löhrke | 101/415.1 |

FOREIGN PATENT DOCUMENTS

| | | |
|---|---|---|
| 0331777 | 9/1989 | European Pat. Off. . |
| 22 52 949 | 7/1977 | Germany . |
| 37 07 066 | 1/1992 | Germany . |
| 40 34 494 | 3/1992 | Germany . |

*Primary Examiner*—Edgar S. Burr
*Assistant Examiner*—Lynn D. Hendrickson
*Attorney, Agent, or Firm*—Jones, Tullar & Cooper

[57] ABSTRACT

A cylinder for a rotary printing press is provided with a press blanket clamping device that is usable to secure the ends of the press blanket to the cylinder. A blanket end ejection device is used to dislodge an edge strip of a blanket leading edge from an edge strip receiving groove portion of the clamping device. The ejection device uses one or more ejection pins and cooperating leaf springs to position the edge strip during its insertion and ejection into and from the press blanket clamping device.

6 Claims, 3 Drawing Sheets

PRESS BLANKET CYLINDER WITH BLANKET END EJECTION DEVICE

FIELD OF THE INVENTION

The present invention is directed generally to a press blanket cylinder for a rotary printing press. More particularly, the present invention is directed to a press blanket cylinder with a blanket end ejection device. Most specifically, the present invention is directed to a press blanket cylinder having a blanket end ejection device located in a cylinder clamping groove. The ejection device is usable to displace an edge strip of a leading end of a press blanket from its engagement with a suspension edge of a groove in the cylinder. The ejection device cooperates with one or more leaf springs which act to urge the edge strip of the first end of the press blanket into the groove.

DESCRIPTION OF THE PRIOR ART

In rotary printing presses, it is generally conventional to secure flexible rubber blankets, flexible printing plates and similar covers, generally referred to as press blankets onto the outer peripheral surface of a rotatable cylinder. A large number of press blanket clamping, holding and tensioning devices are used to releasably clamp and hold the press blanket on the press cylinder. Typically these clamping devices engage leading and trailing edges of the press blanket. Quite frequently, these leading and trailing edges of the press blanket are provided with an edge strip which extends along the lengths of each of the leading and trailing edges of the blanket.

When a press blanket is placed on a cylinder, the leading edge is inserted between a clamping spindle which is located in a cylinder groove and which extends parallel to the direction of rotation of the cylinder, and an insert strip or a wall surface of the cylinder groove. The insert strip or wall surface is provided with an end strip receiving groove that is shaped to receive the edge strip of the leading end of the press blanket. A suspension edge of the end strip receiving groove engages the end strip and acts to hold the leading edge of the press blanket in the clamping groove. Once the leading edge of the press blanket has been secured in the clamping groove, the blanket is wrapped around the cylinder, often as the cylinder is rotated, until the second or trailing edge of the press blanket can be inserted into an elongated slot in the clamping spindle.

One limitation of this type of clamping assembly is that the leading edge of the press blanket sometimes will slip out of its receiving groove before the second end of the blanket can be inserted into the clamping spindle and tensioned. This is particularly the situation when the cylinder is being rotated to wrap the press blanket about it. A second limitation with the prior art clamping devices is that it is frequently difficult to dislodge the edge strip of the leading edge of the press blanket from its receiving groove. The leading edge strip has a tendency to stick to the side wall of the cylinder groove or to the surface of the groove especially if a particular press blanket has been in place on the surface of the cylinder for a lengthy period of time.

It will thus be seen that a need exists for a press blanket cylinder which overcomes the limitations of the prior art devices. The press blanket cylinder with blanket end ejection device in accordance with the present invention overcomes the limitations of the prior art devices and is a significant advance in the art.

SUMMARY OF THE INVENTION

It is an object of the present invention to provide a press blanket cylinder for a rotary printing press.

Another object of the present invention is to provide a press blanket cylinder with a blanket end ejection device.

A further object of the present invention is to provide a press blanket cylinder having a blanket end ejection device located in a cylinder clamping groove.

Yet another object of the present invention is to provide a blanket end ejection device which utilizes a sliding ejection pin to unseat an edge strip.

Still a further object of the present invention is to provide a press blanket end ejection device that utilizes at least one leaf spring to guide the blanket edge strip into its receiving groove.

As will be set forth with particularity in the description of the preferred embodiment which is presented subsequently, the press blanket cylinder in accordance with the present invention includes a cylinder groove that carries a clamping spindle. The cylinder groove receives first and second insert strips which define a space for the clamping spindle. A first face of the first insert strip has a press blanket leading edge strip receiving groove which includes a suspension edge. In use, the edge strip of the leading edge of a press blanket is inserted between the clamping spindle and the face of the first insert strip. The edge strip is guided in part by leaf springs into its cooperating edge strip receiving groove. One or more ejection device are located in the first insert strip. Each such ejection device has an elongated pin which is slidably disposed in the insert strip for reciprocating movement. A free end of each ejection pin can be brought into contact with a side flank of the leading edge strip by use of a piston/cylinder assembly, a rotatable cam or the like. Once the ejection pin end engages the edge strip's flank, the edge strip can be ejected or displaced from the groove in which it had been located.

The press blanket end ejection device in accordance with the present invention makes the removal of the first or leading end of a rubber blanket or a press blanket from the cylinder groove of a cylinder much more easily accomplished. This is because the free end of the ejection pin will force the edge strip out of its cooperating groove. Even if the edge strip has been in the groove for a long period of time and thus may have become stuck in this groove, the ejection device of the present invention makes it possible to remove the press blanket quickly and dependably even after long use. The ejection device, with its cooperating leaf springs also facilitates the placement process by which the leading end of a fresh press blanket can be dependably secured in the cylinder.

The press blanket cylinder with a blanket end ejection device in accordance with the present invention overcomes the limitations of the prior art. It is a substantial advance in the art.

BRIEF DESCRIPTION OF THE DRAWINGS

While the novel features of the press blanket cylinder with a blanket end ejection device in accordance with the present invention are set forth with particularity in the appended claims, a full and complete understanding of the invention may be had by referring to the detailed description of the preferred embodiment which is presented subsequently, and as illustrated in the accompanying drawings, in which:

DESCRIPTION OF THE PREFERRED EMBODIMENT

Figure 1:
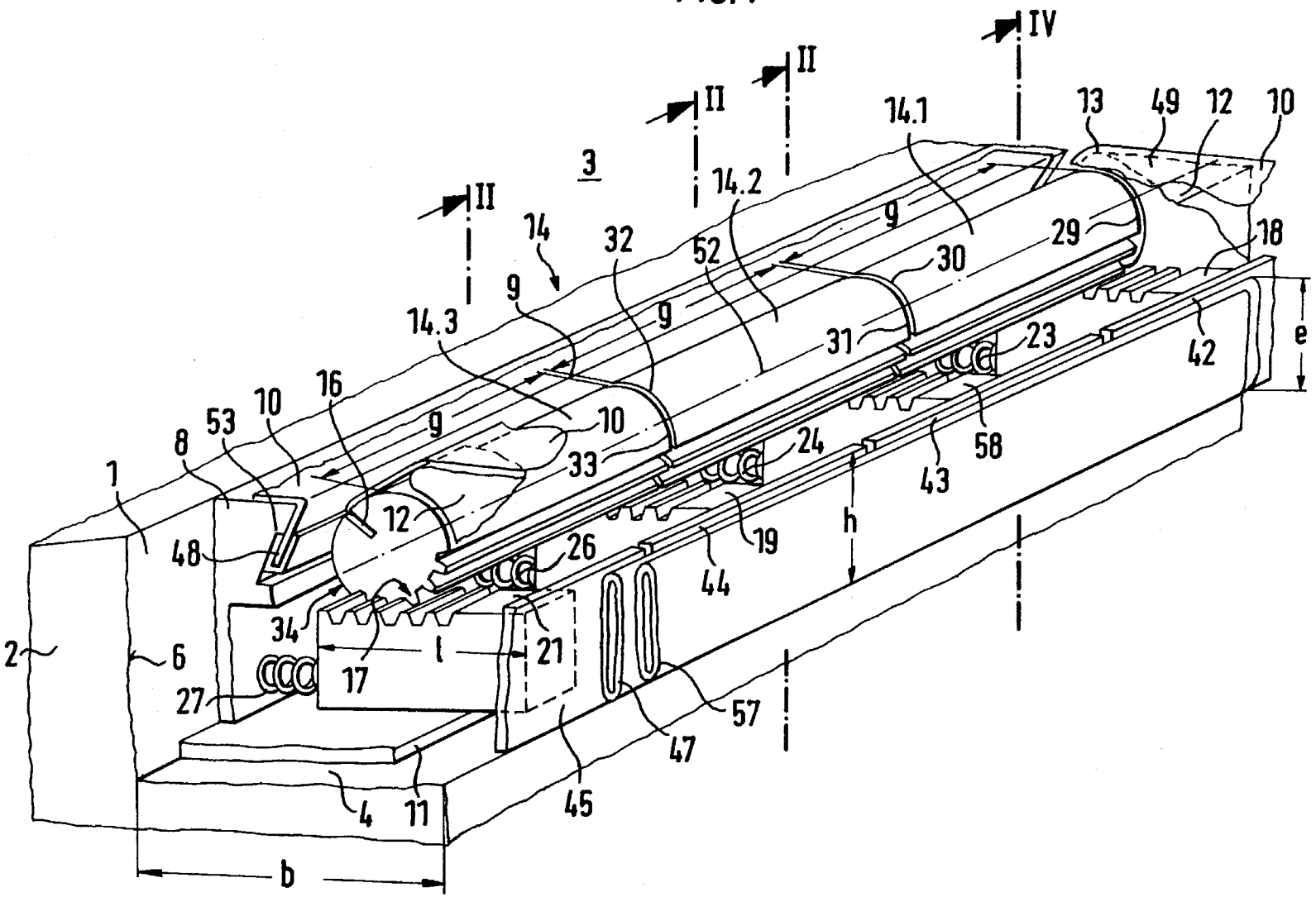
FIG. 1 is a perspective view of a press blanket cylinder with a blanket end ejection device in accordance with the present invention in a clamping position and with portions removed for clarity.

Referring initially to FIG. 1, there may be seen generally at 3 a preferred embodiment of a clamping device for clamping a rubber blanket or a flexible printing plate or the like, generally at 10, and hereinafter referred to as a press blanket, to an outer surface of a cylinder 2 of a rotary printing press in accordance with the present invention. The cylinder 2 is supported for rotation about a central axis of rotation and may be supported and driven by suitable supports and drive means which are generally conventional, which are not shown in the drawings, and which do not form a part of the subject invention. Cylinder 2 is provided with an axially extending cylinder groove 1 which is located at the outer periphery of the cylinder 2. The clamping device, generally at 3, is located in this cylinder groove. The cylinder groove 1 has a flat bottom 4 and two generally radially extending lateral faces 6 and 7. These first and second lateral faces 6 and 7 extend from the groove bottom 4 to the outer periphery of the cylinder 1.

A first insert strip 8 is placed in cylinder groove 1 adjacent the first lateral face 6. This insert strip 8 has a radially outer free edge 9 which is formed at an acute angle to the radius of the cylinder 1, and which extends parallel to, the axis of rotation of the cylinder 2. The first insert strip 8 is used to secure a first end 48 of the press blanket 10 in place on the cylinder 2 in a manner which will be discussed in more detail shortly. The first insert strip 8 has a radially inner portion which is seated adjacent the bottom 4 of the cylinder groove 1 on a base plate 11.

A second insert strip 12 is placed in the cylinder groove 1 generally adjacent the second side face 7 of the groove. This second insert strip 12 has a radially outer face that is provided with a rounded free edge 13. This free edge 13 is formed at an acute angle to the radius of the cylinder 1 and extends the length of the second insert strip 12 parallel to the axis of rotation of the cylinder 2. A second end 49 of the press blanket 10 is pulled over this rounded edge 13 of the second insert strip 12 and is brought to a clamping spindle 14 which will be described in detail shortly. The second end 49 of the press blanket 10 is held and tensioned by the clamping spindle 14. The first insert strip 8 and the second insert strip 12 may be connected to each other, generally adjacent the base plate 11, in a suitable manner.

Figure 2:
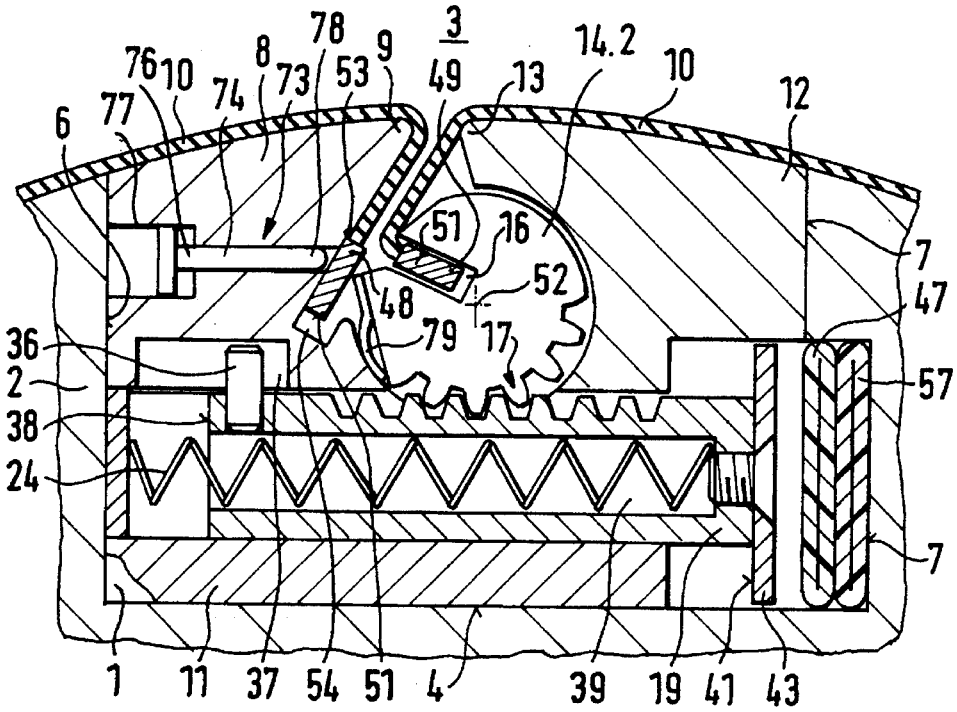
FIG. 2 is a cross-sectional view taken along line II—II of FIG. 1 and showing the device in a clamping position.
Figure 3:
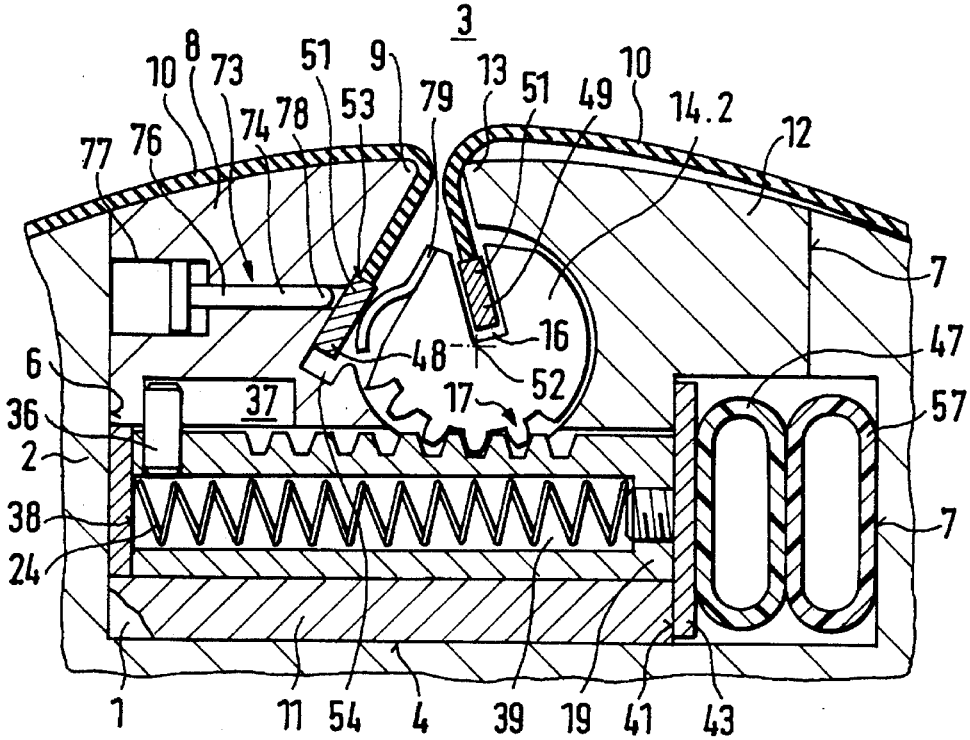
FIG. 3 is a view similar to FIG. 2 and showing the clamping device in a press blanket unclamping position.
Figure 4:
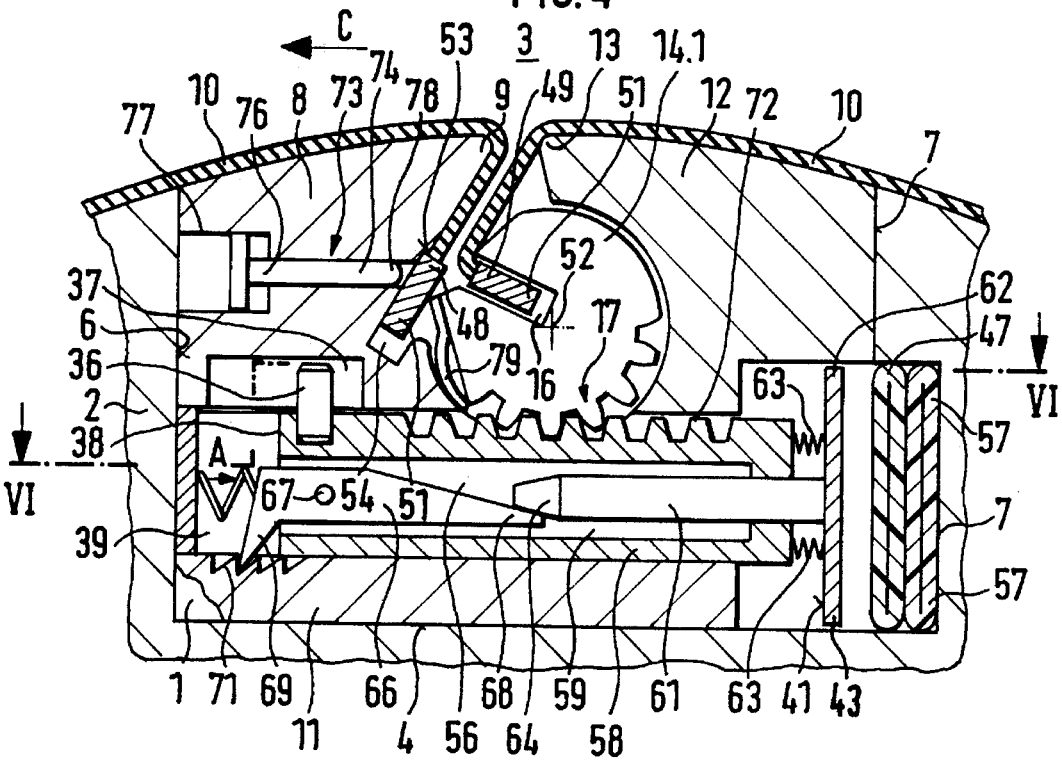
FIG. 4 is a cross-sectional view taken along line IV—IV of FIG. 1 and showing a blocking device in accordance with the present invention.

As may be seen most clearly in FIGS. 2–4, as well as in FIG. 1, the first and second ends 48 and 49 of the press blanket 10 each have an elongated edge strip 51. The edge strip 51 of the first press blanket end 48 engages a suspension edge 53 of an edge strip receiving groove 54 that is formed in the first insert strip 8. This suspension edge 53 extends parallel to the axis of rotation 52 of the clamping spindle 14 which is placed in the cylinder groove 1. The clamping spindle may be made up of cooperating clamping spindle elements 14.1 to 14.4 with all of these elements being supported in a hollow area between the first and second insert bars 8 and 12 by a plurality of generally circumferentially extending toothed racks 18, 19, 21 and 22. The clamping spindle is generally circular in cross-section, as shown in FIGS. 2 and 3 and has an axially extending slit or slot 16 for receiving the second end 49 of the press blanket 10 which will be clamped to the cylinder 2 by use of the clamping device 3. A portion of the circumferential surface of the clamping spindle 14, generally diametrically opposite to the slit 16, is provided with a plurality of axially extending teeth 17. This band of teeth 17 has a length "g" which is the same as the length of each clamping spindle segment 14.1–14.4 or is equal to the overall length of the clamping spindle 14. The tip circle of the band of teeth 17 can be the same as the diameter of the clamping spindle 14.

As mentioned previously, the clamping spindle or shaft 14 can be divided into four individual clamping spindle elements 14.1, 14.2, 14.3 and 14.4. Each of this spindle elements is of the same length and clamping spindle element 14.4 is not specifically shown in FIG. 1. These several clamping spindle elements are supported at their ends by top portions of toothed racks 18, 19, 21 and 22. The toothed racks 18, 19, 21 and 22, as well as any other toothed racks that might be required to support additional cylinder spindle elements not specifically shown, are slidably supported on the base plate 11 in the cylinder groove 1 for generally circumferential sliding movement. Upper surfaces of the toothed racks 18, 19, 21 and 22 have toothed portions which engage the tooth bands 17 on the cylinder spindle elements 14.1, 14.2, 14.3 and 14.4 Each of the toothed racks 18, 19, 21 and 22 is generally square in cross-section and has a length "l" which is approximately 0.6 to 0.8 times the width "b" of the cylinder groove 1. The toothed racks 18, 19, 21 and 22 are forced across the bottom 11 of the cylinder groove 1 generally to the right as seen in FIGS. 1–4 by a plurality of compression springs 23, 24, 26 and 27. This circumferential travel of the toothed racks 18, 19, 21 and 22 will rotate the clamping spindle 14 in a counterclockwise direction, as viewed in FIGS. 1–4 and will cause the press blanket 10 to become tightened. The toothed racks could also have a circular cross-section, if desired. These toothed racks 18, 19, 21 and 22 are situated beneath the respective ends 29, 30, 31, 32, 33 and 34 of the clamping spindle elements 14.1, 14.2, 14.3 and 14.4 of the clamping spindle 14 so that the first end 29 of the clamping spindle element 14.1 engages the toothed rack 18, the second end 30 of the clamping spindle element 14.1 and the first end 31 of the clamping spindle element 14.2 engage the toothed rack 19; the second end 32 of the clamping spindle element 14.2 and the first end 33 of the clamping spindle element 14.3 engage the toothed rack 21 and the second end 34 of the clamping spindle element 14.3 and the not depicted first end of the fourth clamping spindle element 14.4 engage the toothed rack 22. The second end of the not depicted clamping spindle element 14.4 would also engage a toothed rack which is not specifically shown.

Each of the toothed racks 18, 19, 21 and 22 has an upwardly projecting tang 36 formed integrally with its associated rack. Each of these tangs 36 is received in a channel 37 which is formed in the first insert strip 8 and which is bounded by the front edge of the insert strip. The cooperation of the tangs 36 in their channels 37 defines the travel distance of the toothed racks 18, 19, 21 and 22 in the space between the first and second insert strips 8 and 12, respectively. The several channels 37 are parallel to each other and are also parallel to end faces of the cylinder 2. The toothed rack biasing compression springs 23, 24, 26 and 27 can extend into blind bores 39 formed in the toothed racks 18, 19, 21 and 22 with these blind bores 39 extending from first ends 38 of the toothed racks which are adjacent the first side face 6 of the cylinder groove 1 toward second ends 41 of the toothed racks which are facing the second side face 7 of the cylinder groove 1.

A support plate 42, 43, 44 and 45 is secured to each second end 41 of its respective toothed rack 18, 19, 21 or 22 by a screws or the like, as seen in FIGS. 1–4. These support plates are generally parallel with the second lateral face 7 of the cylinder groove 1. Each support plate 42, 43, 44 and 45 is spaced axially slightly apart from its adjacent support plates and each support plate has a height "h" which, as may be seen most clearly in FIGS. 1–4, is greater then the stretched width "e" of an air hose 47 that is disposed between the support plates 42, 43, 44 and 45 and the second lateral face 7 of the cylinder groove 1. Each air hose 47 is closed at a first end and is connected at a second end to a source of compressed air by way of a suitable connector that is not specifically shown. Each such connection allows compressed air to be supplied to, and discharged from the air hose 47 from a suitable source of supply. A second similar air hose 57 is positioned adjacent and parallel to the first air hose 47 and is also connected to a source of compressed air through a suitable connection which again is not specifically shown. The compressed air will typically be supplied to the two air hoses 47 and 57 at a pressure of 4 to 6 bar by a suitable hose. The compressed air connector is located at the end of the clamping device 3 and is connected to the compressed air supply source while the cylinder 2 is stationary.

The cylinder clamping device, generally at 3 is secured to the base plate 11 and, in turn, to the bottom 4 of the cylinder groove 1 by suitable screws or the like, which are not specifically shown. These screws are received in appropriately positioned threaded bores in the bottom 4 of the cylinder groove 1. The base plate 11 is also connected to the first and second insert strips 8 and 12 by retaining screws that are not specifically shown. The sides of the insert strips 8 and 12 which are situated adjacent the clamping spindle 14 are contoured or shaped to be complimentary to the shape of the clamping spindle 14. The first end 48 of the press blanket 10 is placed between the clamping spindle 14 and the adjacent face of the first insert spindle 8, as was previously discussed. The second end 49 of the press blanket 10 is placed in the elongated slit 16 in the clamping spindle 14.

In operation, the first end 48 of the press blanket 10 is inserted into the space between the first insert strip 8 and the clamping spindle 14 until it is received in an edge strip receiving groove 54 which, as viewed in cross-section in FIGS. 2–4, extends in a direction parallel to the axis of rotation of the cylinder. The groove 54 has a suspension edge 53 which, as was discussed previously, is engaged by the edge strip 51 of the first end 48 of the press blanket 10. Once the first end 48 has been secured to the clamping device, the blanket 10 is placed over the edge 9 of the first insert strip 8 and the cylinder 2 can be rotated to wrap the blanket 10 about the cylinder 2 and to bring the blanket second end 49 adjacent the edge 13 of the second insert strip 12. Next, the edge strip 51 of the second end 49 of the press blanket 10 to be placed on the cylinder 2 is inserted in the slit 16 of the clamping spindle 14. The clamping spindle 14 is positioned, during insertion of the second end 49 of the blanket 10, as seen in FIG. 3. This is accomplished by supplying compressed air to the air hoses 47 and 57 to thereby slide the toothed racks to the left against their biasing springs 23, 24, 26 and 27, and to thus rotate the clamping spindle 14 so that its slit 16 is positioned as depicted in FIG. 3.

Once the edge strip 51 of the second end 49 of the press blanket 10 has been inserted into the slit 16 in the clamping spindle 14 or the clamping spindle elements 14.1, 14.2, 14.3 and 14.4, the compressed air supply to the two air hoses 47 and 57 is stopped and the compressed air in the air hoses is released. The springs 23, 24, 26 and 27 can now slide the toothed racks 18, 19, 21 and 22 to the right toward the second lateral face 7 of the cylinder groove 1. This movement of the toothed racks causes the clamping spindle elements 14.1, 14.2, 14.3 and 14.4 to rotate in a counterclockwise direction from the position shown in FIG. 3, which is the unclamped position, to the position shown in FIG. 2, which is the clamped position. This tightens the press blanket 10 on the outer peripheral surface of the cylinder 2. Release of the press blanket 10 is effected by repressurization of the air hoses 47 and 57 to cause the toothed racks 18, 19, 21 and 22 to move to the left back to the unclamped position shown in FIG. 3.

The clamping spindle elements 14.1, 14.2, 14.3 and 14.4 can be removed from the cylinder groove 1 when cleaning or maintenance work is required. The elements can be removed from a space which is located in the cylinder groove 1 between the ends of the clamping device 3 and the bearer rings. This distance between the end of the clamping device 3 and the bearer ring, which is not shown in the drawings, is greater than the length "g" of one of the clamping spindle elements 14.1, 14.2, 14.3 or 14.4. This allows each of the clamping spindle elements to be quickly and easily removed from the cylinder groove 1. If the plate cylinder 2 does not have bearer rings at its ends, it will be understood that the size of a gap between the ends of the clamping device 3 and the press side frames must be greater in length than the length "g" of an individual clamping spindle element 14.1–14.4. This again facilitates the quick and easy removal of the spindle.

Figure 5:
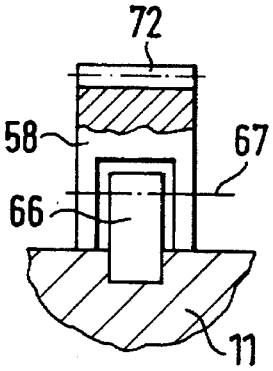
FIG. 5 is a side elevation view of a portion of the blocking device taken in the direction indicated by arrow A in FIG. 4.
Figure 6:
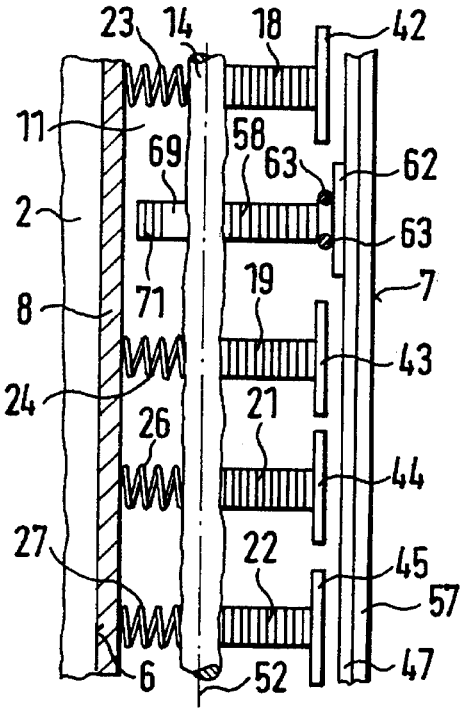
FIG. 6 is a cross-sectional view taken along the line VI—VI of FIG. 4 and showing the toothed racks of the clamping device in accordance with the present invention.

A blocking device, generally at 56, and as may be seen most clearly in FIGS. 4–6, is provided in the clamping device 3 to hold the toothed racks 18, 19, 21 and 22 in place even when the direction of rotation of the cylinder 2 is reversed such that the cylinder 2 will now be caused to rotate in the direction indicated by arrow C in FIG. 4. If the blocking device 56 were not provided, the clamping spindle 14 could tend to move toward the unclamping position depicted in FIG. 3 and this would cause a flexing movement of the press blanket 10. The blocking device, generally at 56 is placed in the cylinder groove 1, generally between two adjacent toothed racks 18, 19, 21 or 22 as may be seen most clearly in FIG. 6. The blocking device 56 will move synchronously with the toothed racks 18, 19, 21 and 22 in a direction crosswise or transverse to the axis of rotation 52 of the clamping spindle 14 during clamping and unclamping of the press blanket 10. As may be seen most clearly in FIG. 4, the blocking device 56 includes a toothed rack 58 that has a central bore 59. An elongated bolt 61 is slidably received in this central bore 59 and has a first end which passes through an aperture in end face 41 of the toothed rack 58 adjacent the second lateral face 7 of the cylinder groove 1. This first end of bolt 61 is connected to a support plate 62 which is spaced apart from the end face 41 of the toothed rack 58 by spaced compression springs 63. A second end of the elongated bolt 61 has a chamfer or wedge-shape, generally at 64. A blocking pawl or two armed lever 66 is pivotably secured by a suitable retaining bolt 67 in the second end 38 of the toothed rack 58; i.e. at the second end of the bore 59. An actuating arm 68 of the blocking pawl 66 is wedge shaped and is in contact with the chamfered end 64 of the elongated bolt 61. A catch arm 69 of the blocking pawl 66 is angled at approximately 45° to the base plate 11 with respect to the actuating arm 68 and has a toothed or pointed free end which is shaped to cooperatively engage a set of teeth 71 which are formed in the base plate 11. The catch 69 is pressed into the teeth 71 by a suitable spring that is not specifically shown. Thus the blocking pawl 66 will hold the toothed rack 58 of the blocking device 56 in the location shown in FIG. 4 and will thus hold the clamping spindle 14 against possible rotation until the blocking pawl 66 is released. This release of the blocking pawl 66 is accomplished by inflation of the air hose 47 and 57. As may be seen by referring to FIG. 6, the support plate 62 that is secured to the end of the elongated bolt 61 is located slightly closer to the inflatable air hoses 47 and 57 than are the other support plates 42, 43, 44 and 45. Thus when the air hoses 47 and 57 are inflated, the support plate 62 will make initial contact with the air hose and will be moved to the left, as seen in FIGS. 4 and 6 against the compression springs 63 and into contact with the end face 41 of the toothed rack 58 of the blocking device 56. This movement will slide elongated bolt 61 to the left so that the chamfered end 64 of bolt 61 will depress the free end of the actuating arm 68 of the blocking pawl 66 which, in turn, will pivot the blocking pawl 66 about its retaining bolt 67 to thereby disengage the free end of the catch arm 69 from the toothed portion 71 of the base plate 11. Once the support plate 62 has been forced against the end face 41 of the toothed rack 59 of the blocking device 56, against the force of the compression springs 63, this toothed rack will move with the other toothed racks 18, 19, 21 and 22 to rotate the clamping spindle 14. The blocking device 56 has no effect on the movement of the toothed racks 18, 19, 21 and 22 to the right under the influence of their compression springs 23, 24, 26 and 27 so that the tension of the press blanket 10 can be regulated by these springs. It is only when the cylinder 1 is rotated in the direction indicated by arrow C so that the press blanket 10 would possibly loosen because of a flexing movement that the blocking device 56 will operate to prevent the toothed racks 18, 19, 21 and 22 from shifting to the left against the force of the compression springs 23, 24, 26 and 27. While only one blocking device 56 is shown in FIG. 1, it will be understood that another blocking device 56 could be positioned between other ones of the spaced toothed racks 18, 19, 21 and 22.

In accordance with the present invention, a press blanket end ejection device, generally at 73, and as may be seen most clearly in FIGS. 2–4 is provided as part of the press blanket clamping device. This ejection device 73 is situated in the first insert strip 8 and is usable to eject or unseat the edge strip 51 of the first end 48 of the press blanket 10 from its engaged position in the edge strip receiving groove 54. The ejection unit 73 includes a slidable pin 74 which is movably guided in the first insert strip 8 in a direction generally parallel to the direction of sliding movement of the toothed racks 18, 19, 21 and 22. A first end 76 of the slidable pin 74 is connected to a piston of a piston-cylinder unit 77. This piston cylinder unit 77 is also carried in the first insert strip 8 and is operated by compressed air that can be supplied from a compressed air source which is not specifically shown. When compressed air is supplied to the piston cylinder unit 77, the pin 74 moves to the right, as seen in FIGS. 2–4 so that a second, free end 78 of pin 74 pushes against a flank surface of the edge strip 51 of the first end 48 of the press blanket 10. This pushes the edge strip 51 toward the axis of rotation 52 of the clamping spindle 14 to unseat the edge strip 51 from the suspension edge 53 of the edge strip receiving groove 54. This releases the first end 48 of the press blanket 10 so that the press blanket 10 can be removed from the surface of the cylinder 2.

A leaf spring 79 is placed on a flat surface portion 81 of the circumference of the clamping spindle 14, adjacent the toothed section 17, as may be seen most clearly in FIG. 3. This leaf spring 79 is used to direct the edge strip 51 of the first end 48 of the press blanket 10 into the groove 54 in the first insert strip 8. The leaf spring 79 is situated on the flat surface portion 81 of the clamping spindle 14 intermediate the slit 16 and the toothed band 17. It is possible to place several ejection units 73 and several counteracting leaf springs 79 spaced apart from each other in the axial direction of the axis of rotation 52 of the clamping spindle 14. In accordance with the present invention, it is also possible to place the leaf spring or springs 79 on a separate holder which would be placed in the cylinder channel 1 or on the base plate 11. This would again be used to locate the leaf springs 79 so that they press against the flank of the edge strip 51. This cooperation of the ejection unit 73 and the leaf springs 79 make it easy to remove the end 48 of the press blanket 10 from the edge strip receiving groove 54 of the cylinder groove 1 or the insert strip 8. Once the first press blanket 10 has been removed, a second press blanket 10 can be substituted for it by pushing the edge strip 51 of the first end 48 of the blanket 10 into the space between the leaf springs 79 and the groove 54 in the first insert strip 8. The leaf springs 79 will act to urge the edge strip 51 into the edge strip receiving groove 54 so that it will hook under the suspension edge 53. When this second press blanket 10 is to be removed, the ejection unit or units 73 can be operated to push the edge strip 51 out of the edge strip receiving groove 54. Instead of a piston cylinder assembly 77, the ejection pins 74 can be displaced in the first insert strip 8 by rotation of a cam shaft. The axis of rotation of such a cam shaft would be generally parallel to the axis of rotation 52 of the clamping spindle 14 and this cam shaft would be supported in the insert strip 8.

While a preferred embodiment of a press blanket cylinder with a blanket end ejection device for a rotary printing press in accordance with the present invention has been set forth fully and completely hereinabove, it will be apparent to one of skill in the art that a number of changes in, for example, the overall size of the cylinder, the drive means for the cylinder, the supply source for the compressed air and the like may be made without departing from the true spirit and scope of the present invention which is accordingly to be limited only by the following claims.

What is claimed is:

1. A blanket end ejection device usable to eject an edge strip of a press blanket from a clamping groove in a press blanket cylinder, said blanket end ejection device comprising:

a press cylinder supported for rotation about an axis of rotation and having a press blanket clamping groove extending generally parallel to said axis of rotation;

an insert strip positioned in said press blanket clamping groove;

an edge strip receiving groove formed in said insert strip and being adapted to engageably receive and hold an edge strip of an end of a press blanket; and at least one ejection pin slidably supported in said insert strip and having a free end which is insertable into said clamping groove into engagement with said edge strip to unseat an edge strip from said edge strip receiving groove.

2. The blanket edge ejection device of claim 1 wherein said free end of said at least one ejection pin is engageable with an edge strip flank of an edge strip received in said edge strip receiving groove, wherein said insert strip has an ejection pin actuating piston and cylinder, and further wherein a second end of said ejection pin is connected with said actuating piston and cylinder for effecting said insertion of said free end of said at least one ejection pin into said edge strip receiving groove.

3. The blanket edge ejection device of claim 1 further including a clamping spindle having a blanket end receiving slit and a toothed band, said clamping spindle being rotatably supported in said clamping groove and with at least one spring being secured to said clamping spindle.

4. The blanket edge ejection device of claim 3 wherein an edge strip is displaceable by said at least one ejection pin toward said clamping spindle against a spring force of said at least one spring.

5. The blanket edge ejection device of claim 3 wherein said at least one spring is secured to a flat surface of said clamping spindle circumferentially between said blanket end receiving slit and said toothed band.

6. The blanket edge ejection device of claim 1 further including at least one spring cooperatively positioned with respect to said at least one ejection pin in said cylinder groove with said at least one ejection pin being displaceable in said cylinder groove against a spring force supplied by said spring.

* * * * *